US009027395B2

(12) United States Patent
Mannucci

(10) Patent No.: US 9,027,395 B2
(45) Date of Patent: May 12, 2015

(54) MEASURING APPARATUS AND METHOD AND APPARATUS FOR DETERMINING A LEAKAGE OF AN INJECTION VALVE

(75) Inventor: Cristiano Mannucci, Leghorn (IT)

(73) Assignee: Continental Automotive GmbH, Hannover (DE)

( * ) Notice: Subject to any disclaimer, the term of this patent is extended or adjusted under 35 U.S.C. 154(b) by 53 days.

(21) Appl. No.: 13/988,935

(22) PCT Filed: Nov. 10, 2011

(86) PCT No.: PCT/EP2011/069792

§ 371 (c)(1), (2), (4) Date: Sep. 12, 2013

(87) PCT Pub. No.: WO2012/069317

PCT Pub. Date: May 31, 2012

(65) Prior Publication Data

US 2013/0340513 A1 Dec. 26, 2013

(30) Foreign Application Priority Data

Nov. 22, 2010 (EP) ..... 10192022

(51) Int. Cl.
*F02M 65/00* (2006.01)

(52) U.S. Cl.
CPC ..... *F02M 65/006* (2013.01); *F02M 65/00* (2013.01)

(58) Field of Classification Search
CPC ..... F02D 2041/225; F02M 65/00; F02M 65/001; F02M 65/006
USPC ..... 73/114.45
See application file for complete search history.

(56) References Cited

U.S. PATENT DOCUMENTS

| | | | | |
|---|---|---|---|---|
| 3,245,256 | A | 4/1966 | Hayward | 73/861.49 |
| 4,012,945 | A | 3/1977 | Bergstrand | 73/49.2 |
| 4,157,656 | A | 6/1979 | Walle | 73/49.2 |
| 4,488,429 | A * | 12/1984 | Ito | 73/114.47 |
| 5,195,362 | A * | 3/1993 | Eason | 73/49.7 |
| 5,212,979 | A * | 5/1993 | Albrodt et al. | 73/37 |
| 5,834,631 | A | 11/1998 | Yamaguti et al. | 73/40 |
| 6,755,076 | B1 * | 6/2004 | Schmidt et al. | 73/114.47 |
| 7,080,551 | B2 * | 7/2006 | Tani et al. | 73/114.52 |

(Continued)

FOREIGN PATENT DOCUMENTS

| | | | | |
|---|---|---|---|---|
| DE | 102004023061 | A1 | 12/2005 | F02M 65/00 |
| WO | 2005/047690 | A1 | 5/2005 | F02M 65/00 |
| WO | 2009/044261 | A2 | 4/2009 | F02M 65/00 |
| WO | 2012/069317 | A1 | 5/2012 | F02M 65/00 |

OTHER PUBLICATIONS

European Search Report, Application No. 10192022.1, 5 pages, Apr. 29. 2011.

(Continued)

*Primary Examiner* — Freddie Kirkland, III
(74) *Attorney, Agent, or Firm* — King & Spalding L.L.P.

(57) ABSTRACT

A measuring apparatus may include a first chamber, a second chamber and a membrane separating the first chamber and the second chamber. Furthermore the measuring apparatus may include a notch in an outer wall of the first chamber designed to liquid-tightly arranging an injection valve in this notch such that an injection nozzle of the injection valve opens out into the first chamber. The measuring apparatus may include a sensor designed and arranged to capture a first measured variable representative for a strain of the membrane.

13 Claims, 3 Drawing Sheets

(56) References Cited

U.S. PATENT DOCUMENTS

| | | | | |
|---|---|---|---|---|
| 7,197,918 | B2 * | 4/2007 | Shen | 73/114.51 |
| 7,878,051 | B2 * | 2/2011 | Tani et al. | 73/114.48 |
| 8,646,321 | B2 * | 2/2014 | Ueno | 73/114.41 |
| 2007/0240500 | A1 * | 10/2007 | Pollard et al. | 73/119 A |
| 2009/0013767 | A1 | 1/2009 | Tani et al. | 73/54.15 |

OTHER PUBLICATIONS

International Search Report and Written Opinion, Application No. PCT/EP2011/069792, 9 pages, Dec. 5, 2011.

Chinese Office Action, Application No. 201180056022.4, 13 pages, Oct. 10, 2014.

* cited by examiner

MEASURING APPARATUS AND METHOD AND APPARATUS FOR DETERMINING A LEAKAGE OF AN INJECTION VALVE

CROSS-REFERENCE TO RELATED APPLICATIONS

This application is a U.S. National Stage Application of International Application No. PCT/EP2011/069792 filed Nov. 10, 2011, which designates the United States of America, and claims priority to EP Application No 10192022.1 filed Nov. 22, 2010, the contents of which are hereby incorporated by reference in their entirety

TECHNICAL FIELD

This disclosure relates to a measuring apparatus as well as to a method and an apparatus for determining a leakage of an injection valve, which comprises an injection nozzle, a cavity, a valve needle and a fluid inlet.

BACKGROUND

Injection valves are in wide spread use, in particular for internal combustion engines where they may be arranged in order to dose fluid into an intake manifold of the internal combustion engine or directly into the combustion chamber of a cylinder of the internal combustion engine. A precise dosing of fluid into a combustion chamber of the internal combustion engine contributes to a reduction of noxious emissions from internal combustion engines which are arranged in vehicles. Injection valves for internal combustion engines should also be leakproof during operation and even when the engine is shut off. An uncontrolled dripping of fuel into a fuel combustion chamber may cause a significant increase of a hydrocarbon emission. In this respect, the injection valve is usually tested at the end of a manufacturing process.

SUMMARY

One embodiment provides a measuring apparatus comprising: a first chamber, a second chamber, a membrane separating the first chamber and the second chamber, a notch in an outer wall of the first chamber designed to liquid-tightly arranging an injection valve in this notch such that an injection nozzle of the injection valve opens out into the first chamber, and a sensor designed and arranged to capture a first measured variable representative for a strain of the membrane.

In a further embodiment, the sensor comprises a strain gauge.

In a further embodiment, the measuring apparatus comprises: a first line with a first valve providing a hydraulic communication between the first chamber and the second chamber dependent on a setting of the first valve and a second line with a second valve providing a flow out of a testing fluid out of the second chamber dependent on a setting of the second valve.

Another embodiment provides a method for determining a leakage of an injection valve, which comprises an injection nozzle, a cavity, a valve needle moveable in the cavity preventing a fluid flow out of the injection nozzle in a closing position and enabling the fluid flow out of the injection nozzle apart from the closing position, and a fuel inlet hydraulically coupled to the cavity and to a fluid supply unit designed to provide a testing fluid to the fuel inlet with a given supply pressure, with the injection valve being arranged relative to a measuring apparatus as disclosed above such that the injection nozzle of the injection valve opens out into the first chamber and with the first chamber and the second chamber of the measuring apparatus being filled with a testing fluid during a measurement phase, wherein the method comprises during the measurement phase following steps: controlling the injection valve in order to have the valve needle preventing the fluid flow out of the injection nozzle, controlling the fluid supply unit in order to provide a given test pressure to the testing fluid in the cavity, controlling the fluid supply unit such that this test pressure is maintained during a given time period, capturing the first measured variable, and determining a fluid volume of the testing fluid, which may be flown from the injection valve into the first chamber dependent on the first measured variable.

In a further embodiment, the method comprises following steps prior to the measurement phase: the first and second valve are controlled to have an open setting, the injection valve is activated to inject approximately a given volume of the testing fluid into the first chamber with a given injection pressure, and when approximately the given volume of testing fluid is injected into the first chamber the first and second valve are controlled to have a closed setting.

Another embodiment provides an apparatus for determining a leakage of an injection valve, which comprises an injection nozzle, a cavity, a valve needle moveable in the cavity preventing a fluid flow out of the injection nozzle in a closing position and enabling the fluid flow out of the injection nozzle apart from the closing position, and a fuel inlet hydraulically coupled to the cavity and to a fluid supply unit designed to provide a testing fluid to the fuel inlet with a given supply pressure, with the injection valve being arranged relative to a measuring apparatus as disclosed above such that the injection nozzle of the injection valve opens out into the first chamber and with the first chamber and the second chamber of the measuring apparatus being filled with a testing fluid during a measurement phase, wherein the apparatus is designed to perform during the measurement phase following steps: controlling the injection valve in order to have the valve needle preventing the fluid flow out of the injection nozzle, controlling the fluid supply unit in order to provide a given test pressure to the testing fluid in the cavity, controlling the fluid supply unit such that this test pressure is maintained during a given time period, capturing the first measured variable, and determining a fluid volume of the testing fluid, which may be flown from the injection valve into the first chamber dependent on the first measured variable.

BRIEF DESCRIPTION OF THE DRAWINGS

Exemplary embodiments will be explained in more detail below based on the schematic drawings, wherein:

FIG. 2*a*, 2*b* the measuring apparatus during two different operational status and FIG. 3 a flow chart of a program to determine a leakage of an injection valve.

DETAILED DESCRIPTION

Figure 1:
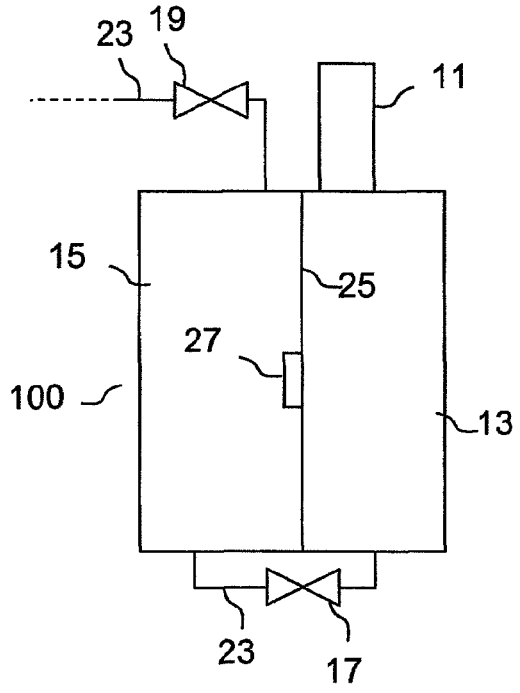
FIG. 1 a schematic drawing of a measuring apparatus.

Some embodiments provide a measuring apparatus and a method and an apparatus for determining a leakage which contribute to a reliable testing of a an injection valve.

For example, some embodiments provide a measuring apparatus comprising a first chamber, a second chamber and a membrane separating the first chamber and the second chamber. Furthermore the measuring apparatus comprises a notch in an outer wall of the first chamber designed to liquid-tightly arranging an injection valve in this notch such that an injection nozzle of the injection valve opens out into the first chamber. The measuring apparatus comprises a sensor designed and arranged to capture a first measured variable representative for a strain of the membrane.

The measuring apparatus contributes to determine a leakage rate of the injection valve very precisely. Advantageously it may be possible to determine very low levels of leakage with such the measuring apparatus. The measurement apparatus may be easily integrated into existing manufacturing leakage testing units. During a measurement phase the first and second chamber are preferably completely filled with a testing fluid and the testing fluid is enclosed in the first and second chamber such that no testing fluid can leak from the first and second chamber. The membrane may be impermeable for the testing fluid. The membrane may comprise a thin wall, like a sheet, of stainless steel. The membrane may comprise another material dependent on the level of leakage to be measured in order to have a further parameter for amplifying a leakage effect. If a first pressure in the first chamber is equal to a second pressure in the second chamber a first volume of the first chamber is equal to a given first inner volume of the first chamber and a second volume of the second chamber is equal to a given second inner volume of the second chamber. If there is a pressure difference between the first chamber and the second chamber the first and second volume depend on the pressure difference.

In one embodiment the sensor comprises a strain gauge. For instance, the strain gauge is arranged in the second chamber at the membrane. The strain gauge may be arranged in a centre of the membrane. The strain gauge may comprise a high sensitivity, so that even micro deformations of the membrane can be reliably captured.

In a further embodiment the measuring apparatus comprises a first line with a first valve providing a hydraulic communication between the first chamber and the second chamber dependent on a setting of the first valve. Furthermore the measuring apparatus comprises a second line with a second valve providing a flow out of a testing fluid out of the second chamber dependent on a setting of the second valve. Such an arrangement may allow that the testing fluid and/or air or another gas resting in the first chamber can be purged into the second chamber and the testing fluid and/or the air or the other gas resting in the second chamber can be purged out of the second chamber. This may allow that for a testing phase the chambers are completely filled with the testing fluid.

Other embodiments provide a method and a corresponding apparatus for determining a leakage of an injection valve. The injection valve comprises an injection nozzle, a cavity, a valve needle moveable in the cavity preventing a fluid flow out of the injection nozzle in a closing position and enabling the fluid flow out of the injection nozzle apart from the closing position, and a fuel inlet hydraulically coupled to the cavity and to an fluid supply unit designed to provide a testing fluid to the fuel inlet with a given supply pressure. The injection valve is arranged such relative to a measuring apparatus according to the first aspect that the injection nozzle of the injection valve opens out into the first chamber. The first chamber and the second chamber of the measuring apparatus are filled with a testing fluid during a measurement phase. The method comprises during the measurement phase several steps. The injection valve is controlled in order to have the valve needle preventing the fluid flow out of the injection nozzle. The fluid supply unit is controlled in order to provide a given test pressure to the testing fluid in the cavity. Furthermore the fluid supply unit is controlled such that this test pressure is maintained during a given time period. The first measured variable is captured and a fluid volume of the testing fluid, which may be flown from the injection valve into the first chamber, is determined dependent on the first measured variable.

In this way it may be possible to determine a leakage rate of the injection valve very precisely and it may be possible to determine very low levels of leakage. Advantageously the testing fluid leakage rate may correlate very good to a fuel leakage rate of the injection valve being operated in an internal combustion engine. For instance, the testing fluid leakage rate may correlate much better to the fuel leakage rate than a gas leakage rate, which can also be used to estimate the fuel leakage rate of the injection valve being operated in an internal combustion engine.

Preferably the test pressure is about a fuel pressure normally applied to the fluid inlet of the injection valve during operation, e. g. about 150 bar to 200 bar for an injection vale of an direct-injection gasoline engine or about 2000 bar for an injection valve of a diesel engine with a common-rail injection. In case of a leakage of the injection valve a fluid volume introduced into the first chamber may generate a delta pressure in the first chamber. The differential pressure between the first chamber and the second chamber may cause a deformation of the membrane. The deformation of the membrane may be linear dependent on the fluid volume introduced into the first chamber. The first volume of the first chamber and the second volume of the second chamber may be determined dependent on the strain of the membrane. Dependent on this first volume and second volume the leakage rate may be determined.

In a further embodiment the method comprises following steps prior to the measurement phase: The first and second valve are controlled to have an open setting. Furthermore the injection valve is activated to inject approximately a given volume of the testing fluid into the first chamber with a given injection pressure. When approximately the given volume of testing fluid is injected into the first chamber the first and second valve are controlled to have a closed setting. In this way the testing fluid and/or air or another gas resting in the first chamber may be purged into the second chamber and the testing fluid and/or the air or the other gas resting in the second chamber may be purged out. The volume of testing fluid injected into the first chamber may be, for instance, equal or higher than the first inner volume of the first chamber or the second inner volume of the second chamber depending on which of both is higher. In this way it may be possible to secure that for the measurement phase the first and second chamber are completely filled with the testing fluid and no air and/or another gas rests in the chambers. If the injector is new and/or is connected to the measuring apparatus the cavity of the injector may comprise some air which may distort the measurement of the leakage because the air has a different density as a fluid, e. g. the testing fluid. In this way it may also be possible to secure that the air in the cavity is purged out and that during the measurement phase no air from the injector leaks into the first chamber.

Preferably the injecting pressure may be about 5 bar to 20 bar, that means much smaller than a fuel pressure applied to the injection valve during normal operation, avoiding a mixture of testing fluid and air resting in the cavity and/or in the chambers which may cause air bubbles in the testing fluid.

The measuring apparatus 100 shown in FIG. 1 may be used for a manufacturing test of injection valves 11. The measuring apparatus 100 comprises a first chamber 13 and a second chamber 15. Furthermore the measuring apparatus 100 comprises a membrane 25 which separates the first chamber 13 and the second chamber 15. The membrane 25 may comprise or may be of a sheet of stainless steel. The membrane 25 may comprise at least another material depending on a requirement of a strain characteristic. FIG. 1 shows the measuring apparatus 100, wherein a first pressure of the first chamber 13 is equal to a second pressure in the second chamber 15. In this case the membrane 25 does not show a deformation. In this case the first chamber 13 may comprise a given first inner volume and the second chamber 15 a given second inner volume. The first and second inner volume can be equal or different, for instance the first and second inner volume may be 1 liter.

In addition the measuring apparatus 100 comprises a notch in an outer wall of the first chamber 13 designed to liquid-tightly arranging an injection valve 11. The injection valve 11 may comprise an injection nozzle, a cavity, a valve needle moveable in the valve needle preventing a fluid flow out of the injection nozzle in a closing position and enabling the fluid flow out of the injection nozzle apart from the closing position. The injection nozzle may be, for example, an injection hole. However, it may be also be of some other type suitable for dosing fluid. The injection valve 11 may be arranged such relative to the measuring apparatus 100 that the injection nozzle of the injection valve 11 opens out into the first chamber 13. It is also possible that the injection valve 11 comprises more than one injection hole. In this case the injection valve 11 may be arranged such relative to the measuring apparatus 100 that the injection holes of the injection valve 11 open out into the first chamber 13. Furthermore the injection valve 11 may comprise a fluid inlet hydraulically coupled with the cavity. For a testing of the injection valve 11 the fluid inlet may be hydraulically coupled with a fluid supply unit, which may be designed to provide a testing fluid to the fuel inlet with a given supply pressure.

Furthermore the measuring apparatus 100 comprises a sensor 27 designed and arranged to capture a first measured variable representative for a strain of the membrane 25. The sensor 27 may comprise a strain gauge. As shown in FIG. 1 the sensor 27 may be arranged in the second chamber 15 at a centre of the membrane 25. Additionally or alternative it may be possible that the sensor 27 is arranged in the first chamber 13 at the membrane 25.

Additionally the measuring apparatus 100 may comprise a first line 21 with a first valve 17 providing a hydraulic communication between the first chamber 13 and the second chamber 15 dependent on a setting of the first valve 17. Furthermore the measuring apparatus 100 may comprise a second line 23 with a second valve 19 providing a flow out of the testing fluid out of the second chamber 15 dependent on a setting of the second valve 19.

In addition the first chamber 13 may comprise a first pressure sensor and the second chamber 15 a second pressure sensor. Capturing the first pressure in the first chamber 13 with the first pressure sensor and capturing the second pressure in the second chamber 15 with the second pressure sensor may allow to verify the first measured variable of the sensor 27.

Figure 2A:
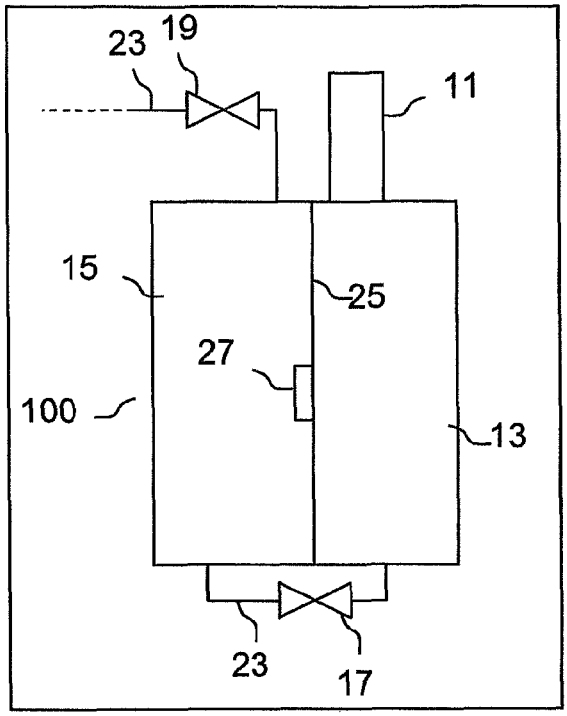
Figure 2A:
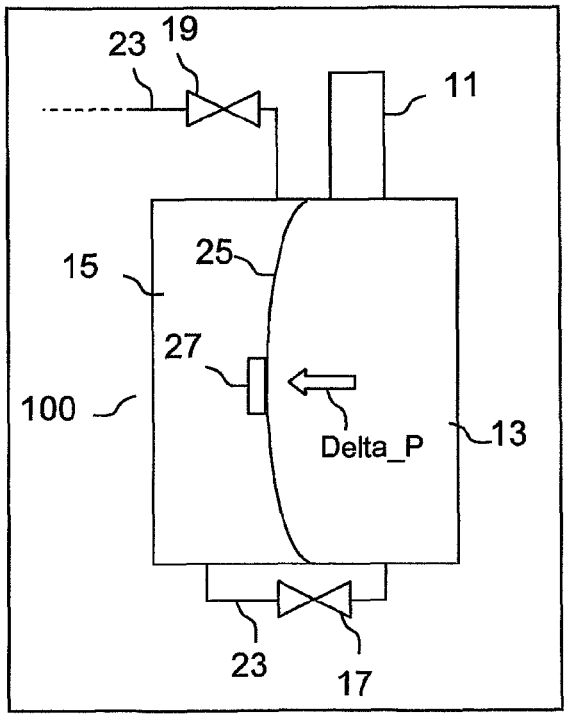
Figure 3:
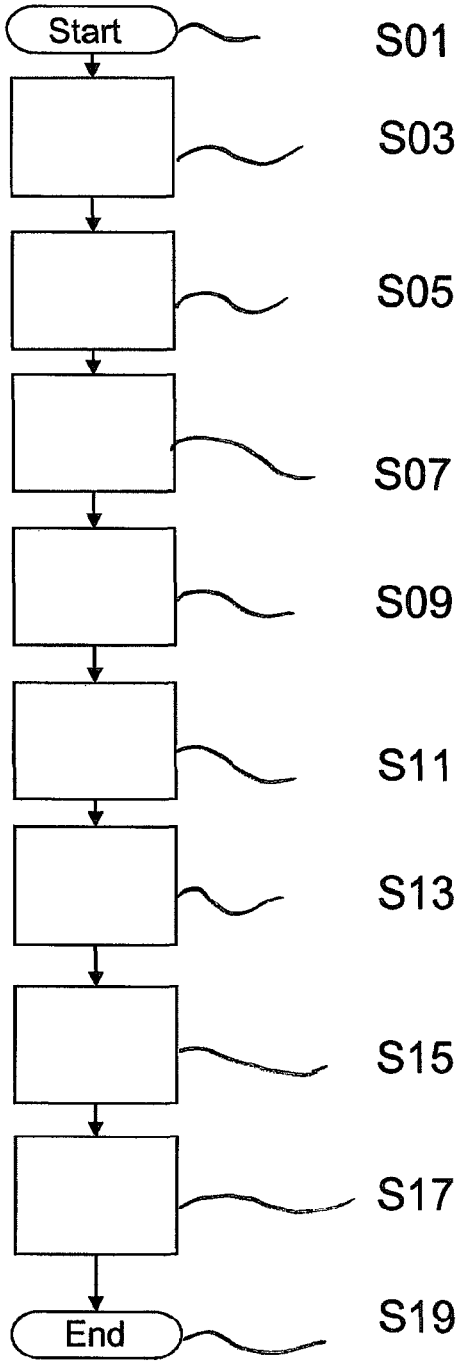

FIG. 2*a* shows the measuring apparatus 100 during a first operational phase, e. g. during a purging phase, when the first valve 17 and the second valve 19 have an open setting and the first pressure in the first chamber 13 is equal to the second pressure in the second chamber 15. FIG. 2*b* shows the measuring apparatus 100 during a second operational phase, e. g. during a measuring phase or at the end of the measuring phase, when the first valve 17 and the second valve 19 have an closed setting and the first pressure in the first chamber 13 is, e. g. higher, than the second pressure in the second chamber 15. For instance, during the measurement phase the first pressure in the first chamber 13 increases dependent on a leakage of the injection valve 11. A pressure difference Delt_P between the first chamber 13 and the second chamber 15 causes a deformation of the membrane 25. If the first pressure in the first chamber 13 is higher than the second pressure the membrane 25 bends vertically into the direction of the second chamber 15. In this case a first volume of the first chamber 13 and a second volume of the second chamber 15 depend on the pressure difference. The first volume of the first chamber 13 and the second volume of the second chamber 15 may be determined dependent on the first measured variable, which is representative for the strain of the membrane 25. Dependent on this first volume and second volume the leakage rate may be determined.

An apparatus for determining the leakage of the injection valve 11 may comprise a processor unit with a program and a data memory. The apparatus may be at least a part of a testing control unit. The apparatus may be designed to perform a program to determine the leakage of the injection valve 11, wherein the program comprises several steps described below.

In a step S01 the program is started. In a step S03 the first 17 and second valve 19 are controlled to have an open setting.

In a step S05 the injection valve 11 is activated to inject approximately a given volume of the testing fluid into the first chamber 13 with a given injection pressure. The injection pressure may be about 5 bar. In this way a mixture of air and the testing fluid resting in the chambers and the cavity can be avoided.

When approximately the given volume of testing fluid is injected into the first chamber 13 the first 17 and second valve 19 are controlled in a step S07 to have a closed setting. The volume of testing fluid may be at least equal to the first inner volume of the first chamber 13 or at least equal the second inner volume of the second chamber 15 dependent on which of both is bigger. At this stage the first chamber 13 and the second chamber 15 of the measurement apparatus are completely filled with the testing fluid. Also the cavity of the injection valve 11 is filled with the testing fluid.

At this stage the measurement phase is started. In a step S09 the injection valve 11 is controlled in order to have the valve needle preventing the fluid flow out of the injection nozzle.

In a step S11 the fluid supply unit is controlled in order to provide a given test pressure to the testing fluid in the cavity.

In a further step S13 the fluid supply unit is controlled such that this test pressure is maintained during a given time period.

In a step S15 the first measured variable is captured and in a step S17 a fluid volume of the testing fluid, which may be flown from the injection valve 11 into the first chamber 13, is determined dependent on the first measured variable.

What is claimed is:

1. A measuring apparatus comprising:

a first chamber, a second chamber, a membrane separating the first chamber and the second chamber, a notch in an outer wall of the first chamber configured for receiving an injection valve in a liquid-tight manner such that an injection nozzle of the injection valve opens into the first chamber, a sensor configured and arranged to capture a first measured variable representative of a strain of the membrane, a first line with a first valve providing a hydraulic communication between the first chamber and the second chamber dependent on a setting of the first valve, and a second line with a second valve providing a flow out of a testing fluid out of the second chamber dependent on a setting of the second valve.

2. The measuring apparatus of claim 1, wherein the sensor comprises a strain gauge.

3. The measuring apparatus of claim 1, wherein the notch is formed in the outer wall of the first chamber of the measuring apparatus such that the injection valve opens directly into the first chamber of the measuring apparatus.

4. The measuring apparatus of claim 1, wherein the sensor is physically secured to the membrane such that the sensor moves along with the membrane during a deformation of the membrane.

5. The measuring apparatus of claim 1, wherein:

each of the first chamber and the second chamber of the measuring apparatus is an open chamber configured to receive a volume of fluid, and the sensor is located physically within either the first chamber or the second chamber.

6. A method for determining a leakage of an injection valve comprising an injection nozzle, a cavity, a valve needle moveable in the cavity to prevent a fluid flow out of the injection nozzle in a closing position and enable the fluid flow out of the injection nozzle in a position apart from the closing position, and a fuel inlet hydraulically coupled to the cavity and to a fluid supply unit configured to provide a testing fluid to the fuel inlet with a given supply pressure, with the injection valve being arranged relative to a measuring apparatus including a first chamber, a second chamber, a membrane separating the first chamber and the second chamber, a notch in an outer wall of the first chamber in which the injection valve is received such that the injection nozzle opens into the first chamber, and a sensor configured and arranged to capture a first measured variable representative of a strain of the membrane, the method comprising:

prior to a measurement phase:

controlling a first valve and a second valve of the measuring apparatus to an open setting, activating the injection valve to inject approximately a particular volume of the testing fluid into the first chamber with a particular injection pressure, and upon the injection of approximately the particular volume of testing fluid into the first chamber, closing the first and second valves, and during the measurement phase:

controlling the injection valve such that the valve needle prevents the fluid flow out of the injection nozzle, controlling the fluid supply unit to provide a particular test pressure to the testing fluid in the cavity, controlling the fluid supply unit to maintain the particular test pressure during a particular time period, using the sensor of the measuring apparatus to capture the first measured variable representative of the strain of the membrane, and determining a fluid volume of the testing fluid that may be delivered from the injection valve into the first chamber based on the first measured variable representative of the strain of the membrane.

7. The method of claim 6, wherein the first valve is arranged along a first line providing a hydraulic communication between the first chamber, and the second valve is arranged along a second line providing a flow out of a testing fluid out of the second chamber.

8. An apparatus for determining a leakage of an injection valve comprising an injection nozzle, a cavity, a valve needle moveable in the cavity to prevent a fluid flow out of the injection nozzle in a closing position and to enable the fluid flow out of the injection nozzle in a position apart from the closing position, and a fuel inlet hydraulically coupled to the cavity and to a fluid supply unit configured to provide a testing fluid to the fuel inlet with a given supply pressure, with the injection valve being arranged such relative to a measuring apparatus including a first chamber, a second chamber, a membrane separating the first chamber and the second chamber, a notch in an outer wall of the first chamber in which the injection valve is received such that the injection nozzle opens into the first chamber, and a sensor configured and arranged to capture a first measured variable representative of a strain of the membrane, wherein the measuring apparatus comprises:

a first line having a first valve providing a hydraulic communication between the first chamber and the second chamber based on a setting of the first valve, and a second line with a second valve providing a flow out of a testing fluid out of the second chamber based on a setting of the second valve, wherein the first and second chambers of the measuring apparatus are filled with a testing fluid during a measurement phase, and wherein the apparatus is configured to, during the measurement phase:

control the injection valve such that the valve needle prevents fluid flow out of the injection nozzle, control the fluid supply unit to provide a particular test pressure to the testing fluid in the cavity, control the fluid supply unit to maintain the particular test pressure is maintained during a particular time period, use the sensor of the measuring apparatus to capture the first measured variable representative of the strain of the membrane, and determine a fluid volume of the testing fluid that may be delivered from the injection valve into the first chamber based on the first measured variable representative of the strain of the membrane.

9. The apparatus of claim 8, wherein the apparatus is further configured to, prior to the measurement phase:

control the first valve and the second valve of the measuring apparatus to an open setting, activate the injection valve to inject approximately a particular volume of the testing fluid into the first chamber with a particular injection pressure, and upon the injection of approximately the particular volume of testing fluid into the first chamber, control the first and second valves of the measuring apparatus to a closed setting.

10. The apparatus of claim 8, wherein the sensor comprises a strain gauge.

11. The apparatus of claim 8, wherein the notch is formed in the outer wall of the first chamber of the measuring apparatus such that the injection valve opens directly into the first chamber of the measuring apparatus.

12. The apparatus of claim 8, wherein the sensor is physically secured to the membrane such that the sensor moves along with the membrane during a deformation of the membrane.

13. The apparatus of claim 8, wherein:

each of the first chamber and the second chamber of the measuring apparatus is an open chamber configured to receive a volume of fluid, and the sensor is located physically within either the first chamber or the second chamber.

* * * * *